US006516478B2

(12) United States Patent
Cook et al.

(10) Patent No.: US 6,516,478 B2
(45) Date of Patent: Feb. 11, 2003

(54) ADJUSTABLE HEIGHT BED

(75) Inventors: Daniel G. Cook, Maple Plain, MN (US); Susan L. Gerlach, St. Croix Falls, WI (US); Gary Peterson, Fredrick, SD (US)

(73) Assignee: Health & Technology, Inc., Plymouth, MN (US)

( * ) Notice: Subject to any disclaimer, the term of this patent is extended or adjusted under 35 U.S.C. 154(b) by 47 days.

(21) Appl. No.: 09/871,497

(22) Filed: May 31, 2001

(65) Prior Publication Data

US 2002/0178501 A1 Dec. 5, 2002

(51) Int. Cl.[7] ..... A47B 7/00

(52) U.S. Cl. ..... 5/611; 5/616; 187/269; 254/124; 108/147

(58) Field of Search ..... 5/611, 616; 187/261, 187/262, 269; 108/76, 35, 144.11, 147, 147.2, 115–117; 254/124, 9 C, 8 C, 88, 90, 94, 122; 14/71.3

(56) References Cited

U.S. PATENT DOCUMENTS

| | | | | | |
|---|---|---|---|---|---|
| 2,829,863 | A | * | 4/1958 | Gibson | 254/8 C |
| 3,110,476 | A | * | 11/1963 | Farris | 254/122 |
| 3,282,566 | A | * | 11/1966 | Clarke | 108/147 X |
| 3,336,606 | A | | 8/1967 | Beitzel | 5/68 |
| 3,686,696 | A | * | 8/1972 | Lanigan | 5/611 |
| 3,785,462 | A | * | 1/1974 | Coad et al. | 187/262 |
| 4,010,826 | A | * | 3/1977 | Jones | 187/269 X |
| 4,534,544 | A | * | 8/1985 | Heide | 254/9 C |
| 4,558,648 | A | * | 12/1985 | Franklin et al. | 108/147 |
| 4,558,847 | A | | 12/1985 | Coates | 254/9 C |
| 4,768,242 | A | | 9/1988 | LoTurco | 5/93 |
| 5,090,070 | A | | 2/1992 | Heinz | 5/611 |
| 5,460,460 | A | | 10/1995 | Alexander | 14/71.3 |
| 5,588,377 | A | * | 12/1996 | Fahmian | 108/147 |
| 5,613,255 | A | | 3/1997 | Bish et al. | 5/611 |
| 5,979,606 | A | * | 11/1999 | Wheeler | 187/269 |
| 6,230,662 | B1 | * | 5/2001 | Miale et al. | 119/727 |
| 6,098,961 | A1 | * | 8/2001 | Gionet | 254/122 |
| 6,286,629 | B1 | * | 9/2001 | Saunders | 187/394 |

FOREIGN PATENT DOCUMENTS

| | | | | |
|---|---|---|---|---|
| DE | 3151031 | * | 5/1983 | 254/10 C |
| DE | 4327897 | * | 3/1994 | 254/8 C |

* cited by examiner

*Primary Examiner*—Jong-Suk (James) Lee
(74) *Attorney, Agent, or Firm*—Kinney & Lange, P.A.

(57) ABSTRACT

An adjustable height platform comprising a bottom platform, a top platform and a scissors linkage secured between the top and the bottom platforms. The scissors: linkage includes scissors legs which pivot about a pivot axis. A drive system provides a horizontal force to the scissors linkage. An unlocking mechanism lifts the pivot axis in response to the horizontal force and unlocks the scissors legs from a collapsed, retracted, and aligned position. After unlocking the legs, the horizontal force continues to raise the top platform with respect to the bottom platform.

16 Claims, 6 Drawing Sheets

ADJUSTABLE HEIGHT BED

BACKGROUND OF THE INVENTION

The present invention relates to an adjustable height platform. More particularly, the present invention relates to an adjustable height platform used to support a bed mattress, such as a hospital bed.

There are significant safety concerns for hospital and nursing home patients, especially elderly patients, associated with falling out of a bed. One approach to addressing the problem is by the use of guard rails on the sides of beds. However, the guard rails present their own risk of injury; for example, appendages may become caught in the space between the guard and the mattress. Belts or tie-down straps have also been used to keep patients from falling out of beds, but have been considered cruel and inhumane. Additionally, some states do not permit belts or tie-down straps to be used in nursing homes.

To overcome the problems associated with the use of guard rails, belts, or straps, some nursing homes have been known to place the mattress of the bed on the floor. This minimizes the distance that a patient would fall if he or she were to roll out of bed and thereby decreases the risk of injury to the patient. However, placing mattresses on the ground makes it very difficult for nurses, doctors, and other caregivers to assist or provide treatment to the patient. Medical personnel working with patients whose mattresses remain on the ground must constantly bend down and over to provide care. As a result, they suffer back injuries, pain, and muscular damage. Additionally, placing mattresses on the floor makes it awkward and uncomfortable for patients to get up from the mattress to stand up or transfer to a chair, wheelchair, or another bed.

Most known hospital beds are able to raise and descend. However, their range of motion is limited. There is no known bed support system capable of lowering to virtually floor level to reduce the risk of injury to patients from falling from a bed while unsupervised, and yet be capable of being raised to a height so that caregivers can tend to the patient from a comfortable, standing position.

The bed described in U.S. Pat. No. 5,090,070 to Heinz has a minimum height of approximately ten inches, or nearly a foot off of the floor to the top of the mattress support platform. Once a mattress is placed upon the bed frame described in Heinz, the top of the mattress would be approximately a foot and a half off of the ground. This height defines the distance a patient may possibly fall before hitting the floor.

Known collapsible beds are not able to lower the bed frame or mattress platform any further than approximately the ten inches disclosed in the Heinz '070 patent. This is due mainly to the clearance required below the bed to house the actuators or drive cylinders used to raise and lower the bed frame.

For example, Bish et al., in U.S. Pat. No. 5,613,255, teaches a bed employing a scissors lift linkage actuated by a hydraulic or air cylinder. As a result, Bish requires significant clearance to house the actuator, thereby limiting the level to which the bed frame can be lowered with respect to the ground. Of course, a pit, much like a mechanic's service pit, could be created beneath the bed to provide the required clearance for the drive mechanism and allow the bed frame to be lowered very close to the floor. However, such a design poses the risk that an appendage of the patient, medical personnel, or visitor may be caught between the bed frame or support lift and the ground as the bed frame is lowered into the pit. This technique would also be cost prohibitive and limit the mobility of the beds. Further, use of hydraulic fluid or air pressure to drive the actuators or drive cylinders may also be undesirable because highly pressurized fluid or air may pose a risk of damage to nearby objects and persons.

There is no known adjustable-height platform, which uses a scissors assembly, that can collapse completely flat without requiring a significant amount of clearance under the bottom platform to house the actuator or drive mechanism that lifts the bed. When a scissors assembly is completely lowered so that it is in a locked position with its legs aligned in the same horizontal plane, there is no prior solution that uses a horizontal force by itself to unlock the scissors assembly. Rather, known prior art beds use an actuator underneath the bottom platform to provide a vertical force on the legs of a scissors support system to break their initial alignment and unlock the aligned legs. This solution, however, requires clearance for the vertically oriented actuator, as discussed above. Such a clearance requirement significantly limits the level to which the bed can be lowered and prevents a scissors type support system from completely collapsing on itself or collapsing to virtually ground level. An alternative solution is to use a bed that does not collapse completely; however, this solution would leave the bed in a semi-raised position and at an unsatisfactory height above the floor.

There is thus no known bed support system which can be lowered to virtually ground level, and that can also be raised to a sufficient height to allow medical personnel to provide assistance at a comfortable height.

BRIEF SUMMARY OF THE INVENTION

The present invention comprises an adjustable height platform system that can function as a bed frame. The system is self contained, and the bed frame can be raised to a height that facilitates medical procedures and treatment. The frame can also be lowered to only a few inches above the floor surface.

The bed frame of the present invention comprises a bottom platform, a top platform, and a scissors linkage coupled between the bottom and the top platforms. The scissors linkage includes scissors legs which pivot about a pivot axis. A drive system provides a horizontal force to the scissors linkage. An unlocking mechanism lifts the pivot axis in response to the horizontal force and unlocks the scissors legs from a collapsed, retracted, and aligned position. After unlocking the legs, the horizontal force continues to raise the top platform with respect to the bottom platform. As the drive system reverses direction and releases the horizontal force provided to the scissors linkage, gravity causes the scissors linkage to collapse and lowers the top platform. At a lowest position, the top platform rests on top of the bottom platform with the scissors linkage, the projection, and the unlocking mechanism being self-contained between the top and the bottom platforms.

DETAILED DESCRIPTION

Figure 1:
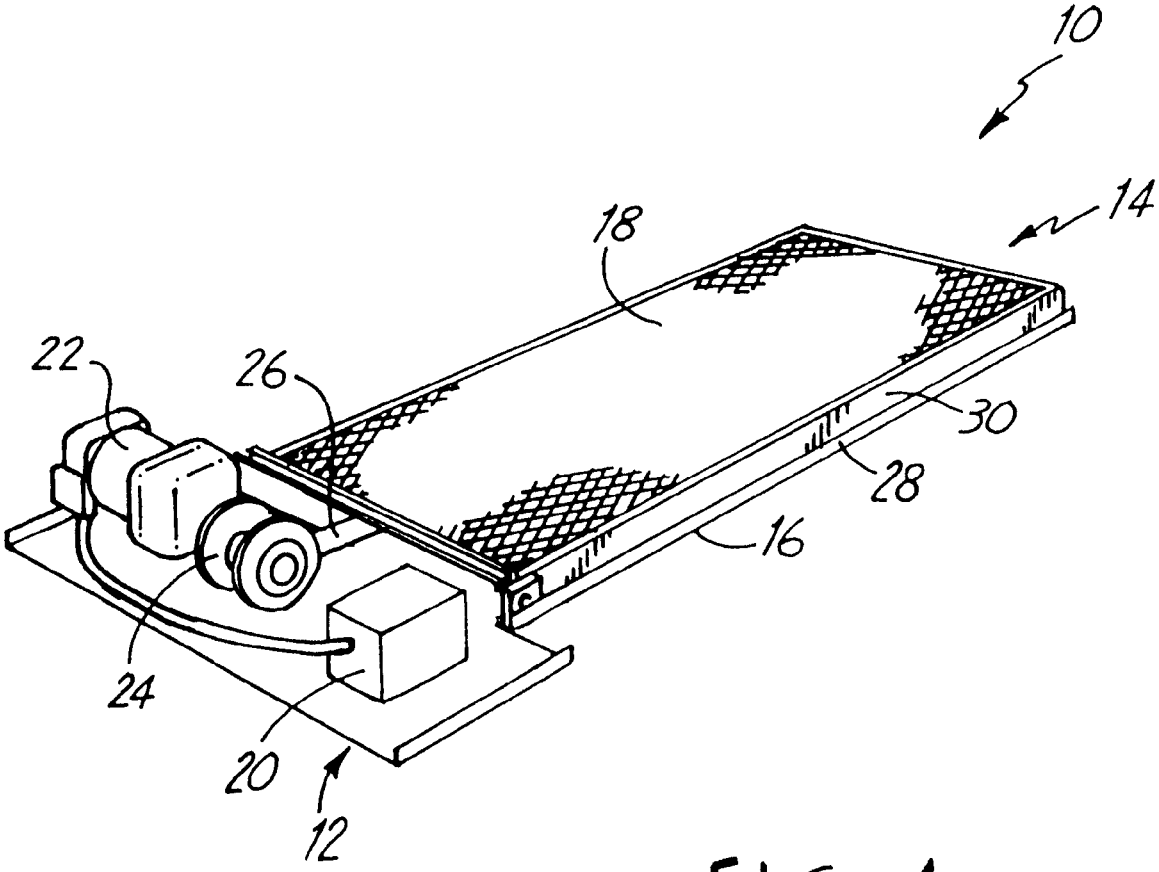
FIG. 1 is a perspective view of the bed frame in a lowered position, viewed from a head end of the bed frame.

FIG. 1 shows generally a perspective view of an adjustable height platform system 10 which can function as a bed to support a mattress. The mattress is not shown in the figures to more clearly illustrate adjustable height platform system or bed frame 10. Bed frame 10 includes generally head end 12 and foot end 14. FIG. 1 illustrates bed frame 10, as viewed from head end 12, in a fully lowered position. Bed frame 10 further includes bottom platform 16 and top platform 18. Bottom platform 16 provides a base for the bed frame 10 and typically sits on the ground or floor. Bottom platform 16 can also include wheels (not shown) to facilitate maneuverability of the bed frame 10. The wheels can be removable or retracted in order to maintain a low frame profile of the bed frame 10. Top platform 18 provides a support surface upon which a mattress can be placed to function as a bed.

As shown in FIG. 1, top platform 18 lowers completely down on top of the bottom platform 16 with the raising mechanisms for bed frame 10 (to be discussed with reference to later figures) completely enclosed between the two platforms. The raising mechanism of the present invention enables bed frame 10 to collapse completely flat. This allows top platform 18 to be a minimum distance off of the ground when in a lowered position, enabling top platform 18 to be at virtually ground level.

FIG. 1 further shows controller 20, drive mechanism 22, spool 24, and strap 26. In operation, controller 20 receives input signals which direct it to start, stop, drive, or reverse drive mechanism 22. Drive mechanism 22 is attached to spool 24. Driven by drive mechanism 22, spool 24 feeds and unfeeds strap 26, which controls the raising and lowering of bed frame 10. The principles of operation will be described with reference to later figures.

Top platform 18 and bottom platform 16 are preferably made of a durable, rust-free material such as stainless steel. In one embodiment, the surface of the top platform 18 comprises a grate which allows for savings in material and weight, while retaining the requisite strength to support a mattress. Bottom platform 16 and top platform 18 may also include side flanges 28 and 30, respectively, which enclose the raising mechanisms when bed frame 10 is in the lowered position.

Figure 2:
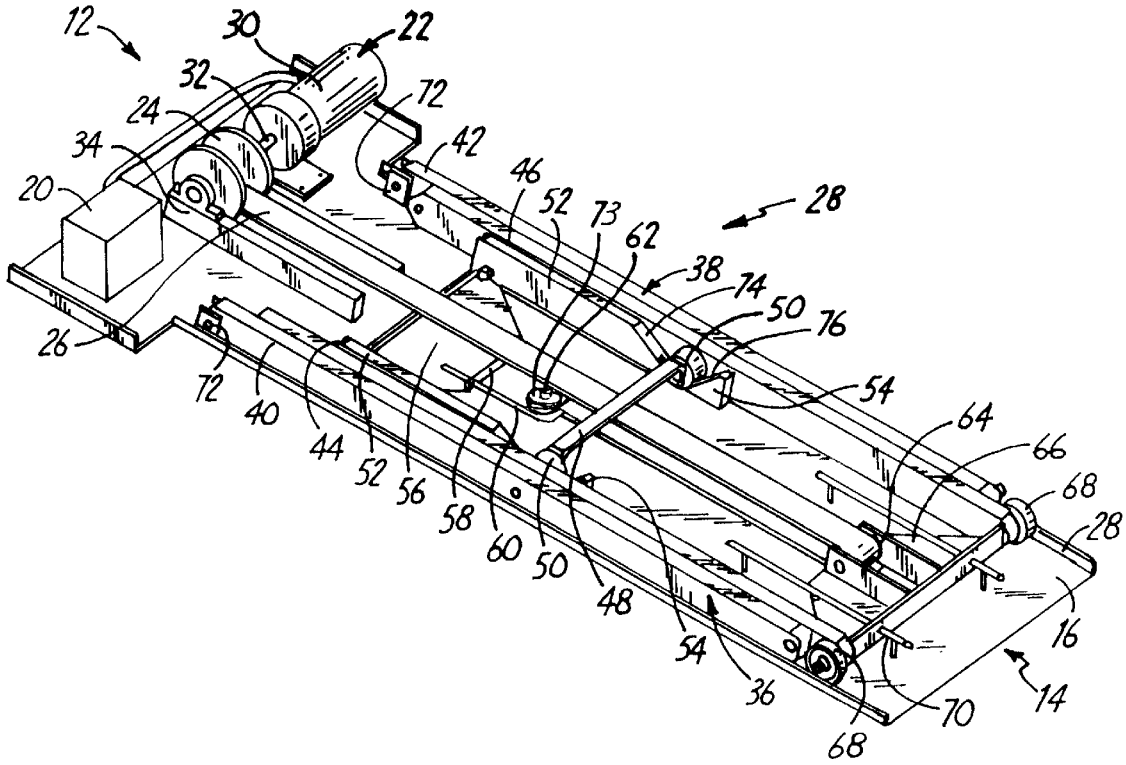
FIG. 2 is a perspective view of the bed frame in a lowered position, with a top platform removed and viewed from a foot end of the bed frame.

FIG. 2 is a perspective view of bed frame 10 in a lowered position, with top platform 18 removed and viewed from foot end 14 of bed frame 10. FIG. 2 further shows motor 30, drive shaft 32, risers 34, left scissors linkage 36, right scissors linkage 38, left outside scissor leg 40, right outside scissor leg 42, left inside scissor leg 44, right inside scissor leg 46, cross brace 48, rollers or projections. 50, first ramp 52, second ramp.54, head plate 56, flange 58, u-shaped bar 60, stopper 62, rod 64, foot plate 66, wheels 68, and slide rod 70.

The lifting mechanism of bed frame 10 includes left scissors linkage 36 and right scissors linkage 40. Left scissors linkage 36 comprises left outside scissor leg 40 and left inside scissor leg 44, which are pivotally connected together at their middle sections to create an "X" centered on a pivot axis when the bed frame 10 is in a raised position. Similarly, right scissors linkage 38 comprises right outside scissor leg 42 and fight inside scissor leg 46. Scissors linkages 36 and 38 connect top platform 18 and bottom platform 16, and thereby provide the structure that supports top platform 18. In an alternate embodiment, a single scissors linkage, or more than two scissors linkages, can be used. However, a preferred embodiment contains dual scissors linkages, one on each side of bed frame 10, to provide support and stability.

Left and right outside scissors legs 40 and 42 are pivotally fixed to bottom platform 16 at the head end 12 of the bed frame 10 by leg pin brackets 72. At their opposite ends, outside scissors legs 40 and 42 are slidably engaged with top platform 18 at foot end 14 of the bed frame 10. Left and right inside scissors legs 44 and 46 are pivotally attached to top platform 18 at head end 12 of bed frame 10, and include a pair of wheels 68 at foot end 14, which allows inside scissors legs 44 and 46 to extend upward and toward head end 12 of bed frame 10 as top platform 18 rises. The ability to fully retract scissors linkages 36 and 38 so that outside legs 40 and 42 and inner legs 44 and 46 are completely aligned and are parallel to each other enables bed frame 10 to lower top platform 18 to virtually ground level when it is in a lowered position.

When inner and outer legs 40, 42, 46, and 48 are aligned in this manner, they can also be described as being in a locked position. The ability to fold a scissors type lifting mechanism into a locked position is not new. However, a vertical component of force was always previously required to unlock the legs 40, 42, 46, and 48 from their parallel alignment or locked position. The vertical force component required a drive mechanism to be either vertically oriented or angled in order to deliver the necessary vertical component of force to unlock the scissors linkages 36 and 38 from their retracted and aligned position. The angled or vertical orientation of the drive mechanism increased the clearance area required for the device.

Bed frame 10 of the present invention overcomes the increased clearance area required by utilizing only a horizontal force from drive system or mechanism 22 to unlock scissors linkages 36 and 38 from their locked and aligned position.

The bottom platform 16 is preferably a metal plate which does not require any special floor surface features for placement, other than a stable, flat surface area. Bottom platform 16 may comprise a single piece of material, as shown in FIG. 2, or it may comprise strips of material in those areas where the raising mechanism of bed frame 10 contacts bottom platform 16. Alternatively, cutout regions may be placed in bottom platform 16 where components of raising mechanism do not travel or require support. By utilizing only strips of material or including cutouts in bottom platform 16, savings in weight and materials can be achieved.

Drive mechanism 22 includes drive shaft 32 driven by motor 30. Spool 24 is secured to the drive shaft 32, and strap 26 is secured at one of its ends to the spool 24. As motor spins in one direction and then in the opposite direction, it will cause drive shaft 32, and in turn, spool 24, to spin. This results in either winding or unwinding strap 26 around spool 24.

Strap 26 is also wrapped around rod 64 of foot plate 66 and is secured at its opposite end to u-shaped bracket 60. It is by way of strap 26 that motor 30 of drive system 22 delivers the horizontal force which initially unlocks the aligned and locked scissors linkages 36 and 38 and then raises scissors linkages 36 and 38 to lift bed frame 10 to its raised position.

To prevent strap 26 from getting caught up in various components of the raising mechanism of bed frame 10, spool 24 is mounted on risers 34. Risers 34 raise the height of spool 24 and thus also raise the height of strap 26 off of bottom platform 16. In a preferred embodiment, stoppers 62 include top covers 73 over which strap 26 passes to ensure that strap 26 does not become entangled or weakened by frictional wear with stoppers 62. Top covers 73 also prevent strap 26 from becoming entangled with either u-shaped bracket 60 or flange 58 of head plate 56.

Strap 26 is preferably a webbed strap that is about three inches wide and approximately seven feet long. Strap 26 is preferably rated at 3000 pounds. Strap 26, however, may be composed of any sufficiently strong and flexible material.

From spool 24, strap 26 is wrapped around rod 64 of foot plate 66. Foot plate 66 is mounted on a pair of horizontal slide rods 70 that are parallel to each other and to strap 26. The foot end 14 of inner legs 44 and 46 are secured to foot plate 66. Wheels 68 are mounted to inner legs 44 and 46 to facilitate movement of foot plate 66 and the raising and lowering of bed frame 10 by scissors linkages 36 and 38.

From rod 64 of foot plate 66, strap 26 is secured at its other unsecured end to u-shaped bracket 60, which is fixedly secured to head plate 56 through upturned flange 58. Head plate 56 is secured to a pair of first ramps 52. A ramped portion 74 of each first ramp 52 is at an end of first ramp 52 opposite its connection point to the head plate 56. Ramped portion 74 of the first ramp 52 also preferably faces a ramped portion 76 of a second ramp 54. Second ramps 54 are fixedly secured to bottom platform 16. Ramped portions 74 and 76 of first and second ramps 52 and 54 thus create a v-shaped valley which receives roller or projection 50. Projection 50 is secured along the inside of the inner legs 44 and 46 at the pivot axis of the scissors linkages 36 and 38. Cross bar 48 is secured between the inner legs 44 and 46 at projections 50 to add stability to bed frame 10.

From the lowered position shown in FIG. 2, bed frame 10 is raised in two stages: a first stage which breaks the horizontal alignment of scissors linkages 36 and 38, and a second stage which causes most of the vertical movement of top platform 18. When bed frame 10 is in a lowered position and motor 30 begins to wind strap 26 around spool 24, strap 26 secured to u-shaped bracket 60 causes head plate 56 to move toward foot end 14 of bed frame 10. Although strap 26 is connected to both head plate 56 and foot plate 66, the horizontal force delivered by strap 26, initially causes movement of head plate 56 rather than foot plate 66. This is because head plate 56 is not secured to scissors linkages 36 and 38, which are at this time in an aligned and locked state. Foot plate 66, however, is connected to the inside scissors legs 44 and 46. Since scissors linkages 36 and 38 are in an aligned and locked orientation that is parallel with the horizontal force applied by strap 26, the horizontal force is not able to overcome the aligned and locked position of scissors legs 44 and 46 and move foot plate 66. Thus, as strap 26 is initially wound around the spool 24, head plate 56 begins to move toward foot end 14 of bed frame 10.

A pair of stoppers or bumpers 62 are fixedly secured to bottom platform 16 and extend up between the u-shaped bracket 60 and the flange 58. Stoppers 62 limit the distance that head plate 56 will move, as defined by the distance between the stoppers 62 and flange 58. This distance must be of a sufficient length to move head plate 56, and in turn first ramps 52 a sufficient distance so that first ramps 52 travel up ramped portions 76 of second ramps 54. This motion causes ramped portions 74 of first ramps 52 to engage and lift projections 50. As projection 50 is lifted or raised, scissors linkages 36 and 38 are unlocked from their aligned and locked orientation. First ramps 52 continue to travel up second ramps 54 until flange 58 of head plate 56 encounters stoppers 62. At this point, first ramps 52 are at the top of second ramps 54. It is preferable that the travel of head plate 56 toward foot end 14 of bed frame 10 is limited so that ramped portion 74 of first ramps 52 do not pass over or slide beyond the top of the ramp portion 76 of second ramps 54. This will prevent first ramp 52 from getting hung up on second ramp 54. At this point, the unlocking stage of movement is complete.

As the strap 26 continues to wind around the spool 24, the horizontal force begins to pull foot plate 66 in the direction of head end 12 of bed frame 10. This pulling force causes wheels 68 on inner legs 44 and 46 to roll toward head end 12 of bed frame 10. This causes the raising of scissors linkages 44 and 46, and lifts top platform 18 to its raised position. Foot plate 66 travels along slide rods 70, which help ensure that the travel is straight and level.

Figure 3:
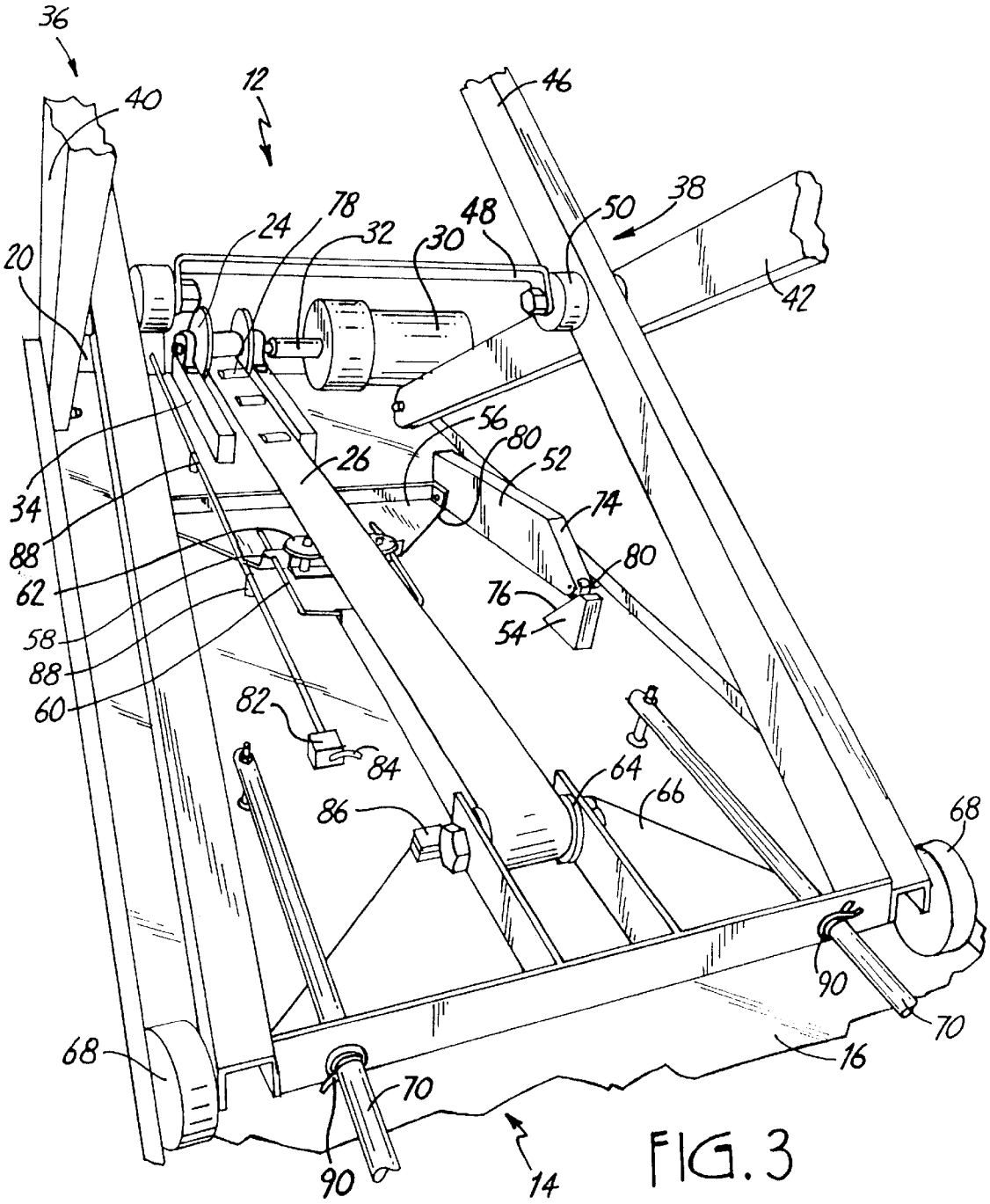
FIG. 3 is a perspective, cutaway view from the foot end of the bed frame in a raised position.

FIG. 3 is a perspective, cutaway view from foot end 14 of bed frame 10 in a raised position. FIG. 3 further shows spacers 78 secured to the strap 26, rollers or wheels 80 on first ramps 52, limit switch 82, limit leg 84, and engagement block 86. Spacers 78 are preferably secured to strap 26 to equilibrate the speed at which the strap 26 is wound and unwound from spool 24. Spacers 78 accomplish this task by increasing the effective diameter of spool 24, and thereby increasing the amount of strap 26 that is wound onto or off of spool 24 in one rotation. This is more of a concern when the bed frame 10 is in a lowered position, which is when the least amount of strap 26 is wrapped around spool 24. As more of strap 26 is wound onto spool 24, the spacing between spacers 78 gradually increases until no further spacers 78 are required. This is because once a sufficient amount of strap 26 has been wound around the spool 24, bed frame 10 is able to maintain a relatively constant and quick raising of top platform 18.

Because of the perspective of FIG. 3, only one first ramp 52 and second ramp 54 can be seen, but in a preferred embodiment, a pair of each ramp is used. To facilitate movement of head plate 56, wheels or rollers 80 can be placed along a bottom surface of first ramp 52, and preferably at each end of first ramp 52.

In FIG. 3, flange 58 has contacted stoppers 62, and first ramps 52 have reached the end of their travel up second ramps 54. The contact between flange 58 and stoppers 62 prevents further movement of head plate 56. Foot plate 66 has started to move toward head end 12 of bed frame 10. This movement continues until limit switch 82 is triggered. Limit switch 82 controls the movement of foot plate 66, and hence the vertical distance to which the top platform 18 is raised. Limit switch 82 provides an input signal to controller 20 indicating when foot plate 66 has moved to its maximum distance and raised top platform 18 to its maximum height. Limit switch 82 thus informs controller 20 to turn off motor 30 once bed frame 10 has been raised.

Limit switch 82 includes limit leg 84, which is actuated by engagement block 86 secured to foot plate 66. When foot plate 66 travels on slide rods 70 to the point where engagement block 86 contacts limit leg 84 of limit switch 82, bed frame 10 is in a fully raised position. Engagement block 86 causes leg 84 of switch 82 to be actuated, which sends a signal to controller 20 to turn off motor 30. In a preferred embodiment, pegs 88 are used to support the wires between the switch 82 and controller 20 so that they do not contact or become entangled with the head plate 56. FIG. 3 also illustrates that foot plate 66 is secured to and slides along the pair of slide rods 70 by couplings 90.

Figure 4:
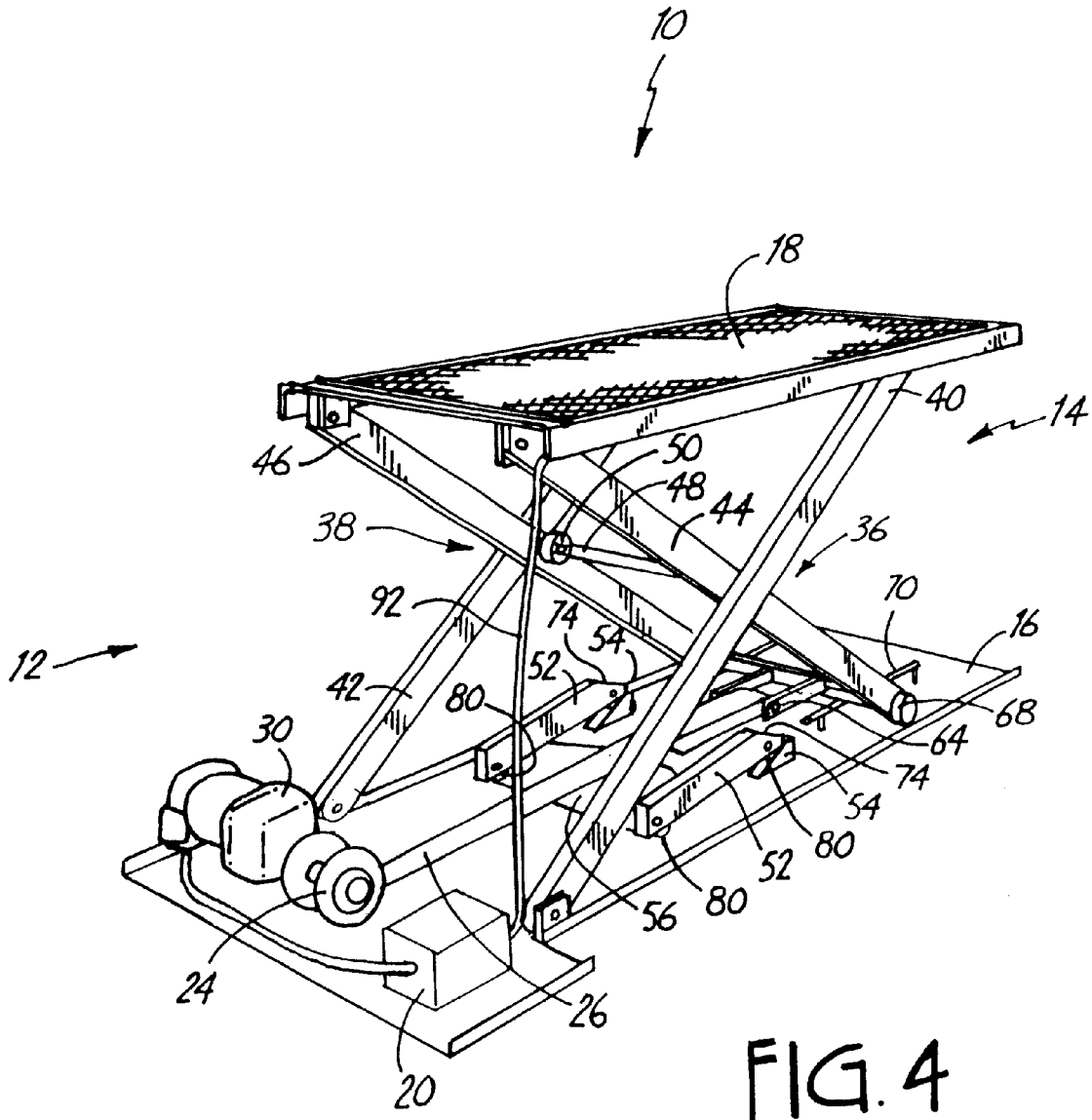
FIG. 4 is a perspective view of a preferred embodiment of the present invention illustrated as a bed frame in a raised position, viewed from a head end of the bed frame.

FIG. 4 is a perspective view of a preferred embodiment of the present invention illustrated as bed frame 10 in a raised position, viewed from head end 12 of bed frame 10. The significance of the invention is illustrated by a comparison of FIGS. 4 and 1, which illustrates the range of motion of the bed frame 10. FIG. 4 illustrates the ability of bed frame 10 to be raised to a normal, or typical, height to afford medical personnel the ability to work on a patient without having to bend or slouch over. The ability of abed to be raised to this height is not new. However, the ability to also collapse bed frame 10 to a lowered position that is virtually at ground level as illustrated in FIG. 1, with a self-contained raising mechanism, has not previously existed. Top platform 18 may be lowered to virtually floor level, or within approximately two to five inches of the floor, yet can also be raised to a height of approximately thirty-eight inches above the floor.

A pneumatic switch (not shown) may be connected to a piece of flexible plastic tubing 92 that is filled with a gas to create a closed system. Tubing 92 may be secured to an underside of top platform 18 that contacts bottom platform 16 when bed frame 10 is at its lowest position. If an object is caught between top platform 18 and bottom platforms 16, flexible tubing 92 will be compressed. A pneumatic or pressure sensing switch will then sense a change of pressure within the plastic tubing 92. The pneumatic switch will then send an input signal to controller 20. The signal is processed by controller 20, which can generate an output signal to stop motor 30 and avoid crushing the object caught between top platform 18 and bottom platform 16.

To lower the top platform 18, motor 30 is operated in the opposite direction to cause spool 24 to unwind strap 26. The weight of bed frame 10, and the supported mattress, will cause wheels 68 to roll on slide rods 70 toward foot end 14 of bed frame 10. This movement causes the slow collapse of scissors linkages 36 and 38. Once projections 50 contact ramped portions 74 of first ramps 52, the weight of the entire assembly causes first ramps 52 to slide down second ramps 54, so that projections 50 rest in the valley between first ramps 52 and second ramps 54. Once completely collapsed, bed frame 10 returns to the position illustrated in FIGS. 1 and 2.

Figure 5:
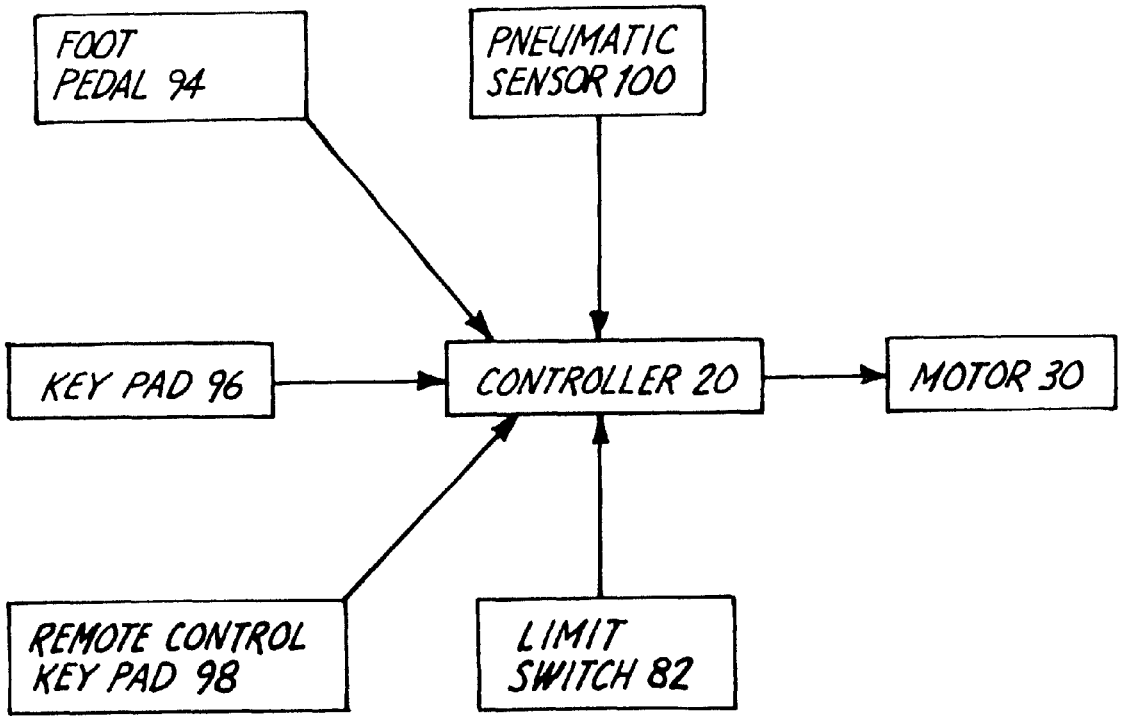
FIG. 5 is a block diagram of inputs and outputs of a controller for the bed frame of the present invention.

FIG. 5 is a block diagram of inputs and outputs of controller 20 for bed frame 10 of the present invention. FIG. 5 further shows foot pedal 94, keypad 96, remote control key pad 98, and pneumatic sensor 100. Drive mechanism 22 includes motor 30 that is controlled and operated by controller 20. Controller 20 receives various input signals, which it processes to send an output signal to motor 30. The output signal directs motor 30 to stop or drive in either a forward or a reverse direction to either raise or lower top platform 18 of bed frame 10. Motor 30 is preferably a standard reversible winch motor such as that manufactured by Dayton, as model number 6Z399A with a 115 volt, 4 amp rating.

Controller 10 may receive an operator input signal to either raise or lower top platform 18. The input signal may be sent, for example, from a foot pedal 94 located near or on the bed, a key pad 96 wired to controller 20, or a remote control key pad 98. Once the input signal is received from the operator, controller 20 directs the operation of motor 30 to either raise or lower top platform 18 as desired.

Other input signals can also be received by controller 20 and incorporated into the manner that bed frame 10 is operated. These input signals can include signals provided for safety, such as those from pneumatic sensor 100, which monitors and senses any change in the pressure within the tubing 92 (shown in FIG. 4). Once a change in pressure within tubing 92 is sensed by pneumatic sensor 100, it sends a signal to controller 20 to immediately shut down motor 30. This will end the operation of either raising or lowering top platform 18 in case an object or body part has accidentally been caught between top platform 18 and bottom platform 16.

Another example of an input signal to controller 20 is a signal from limit switch 82. Limit switch 82 sends a signal to controller 20 when foot plate 66 has reached a point corresponding to a maximum height of top platform 18. When controller 20 receives an input signal, whether from pneumatic sensor 100 or limit switch 82, it will process that signal and send an output signal to motor 30, thereby shutting it down. Those of ordinary skill in the art will recognize that changes or substitutes for switches 82 and 100 can be made, and include for example proximity switches, motion sensors or other well known switches. Controller 20 also analyzes and processes the signals from either the foot pedal 94, hard-wired key pad 96, or remote control key pad 98 to determine the proper output signal to send to motor 30 to either raise or lower bed frame 10.

Figure 6:
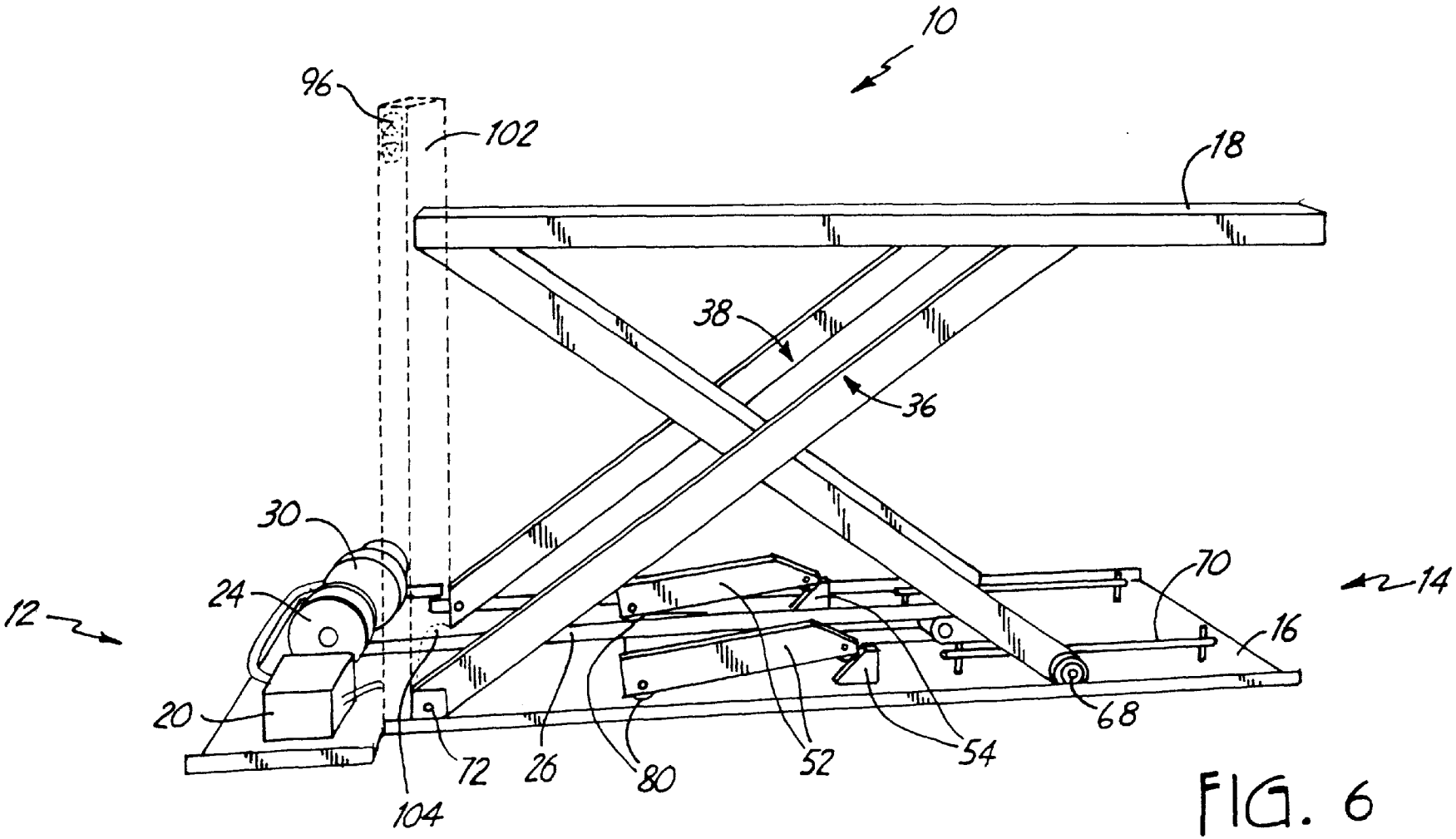
FIG. 6 is a side perspective view of the bed frame in a raised position.

FIG. 6 is a side perspective view of bed frame 10 in a raised position, further illustrating head board 102 with clearance space 104. FIG. 6 illustrates that top platform 18 is raised in a relatively straight vertical direction. It is shown that head end 12 of top platform 18 does not move significantly away from headboard 102 (shown in phantom) when top platform 18 is raised. An example of the keypad 96 used to raise or lower the bed frame 10 is shown secured to headboard 102 (in phantom). Key pad 96 could also be hung on headboard 102 and connected to controller 20 by a cord with sufficient length to allow a patient to hold and operate key pad 96 while lying on the bed.

The headboard 102 may also be used to decoratively hide or disguise controller 20, motor 30, and spool 24. Headboard 102 can also serve as a barrier to prevent injury or damage to persons or objects that may fall on controller 20, motor 30, or spool 24. Headboard 102 should include clearance space 104 through which strap 26 may pass.

Although the present invention has been described with reference to preferred embodiments, workers skilled in the art will recognize that changes may be made in form and detail without departing from the spirit and scope of the invention. For example, while the illustrated embodiment depicts a system using a motor driven spool with a strap that links the head and foot plates together, it is contemplated that the system may be modified to be used instead with hydraulic or air cylinders or other types of actuators, if desired.

For example, a pair of actuators may be placed behind first ramps 52 to move them up second ramps 54; alternatively, a single actuator could move head plate 56, thereby also moving the first ramps 52. A socket for a hand crank could also be incorporated into spool 24 to allow a manual override to the system if desired. While the first ramps 52 preferably travel up the second ramps 54, a single ramp could be used to engage and lift projections 50 to unlock scissors linkages 36 and 38. Also, while first ramps 52 include ramped portion 74 to gradually lift projections 50, other shapes or techniques to break the aligned orientation of the scissors legs with a horizontal force will become obvious to those of ordinary skill in the art. An actuator may also be placed to move foot plate 66 along slide rods 70 toward head end 12 of bed frame 10.

Additionally, bed frame 10 may include an apparatus which provides for articulation of the head end and foot end of a mattress resting upon top platform 18. Such articulation or adjustment systems are known in the art and can easily be fitted to the present invention by one skilled in the art. Moreover, bed frame 10 may include various safety features known in the art for adjustable beds. These alternative embodiments use the teachings of the present invention of a design for an adjustable height platform system which uses only lateral forces to achieve a vertical raising and lowering movement.

What is claimed is:

1. An adjustable height platform system comprising:

a bottom platform;

a top platform positioned above the bottom platform;

a scissors linkage secured between the bottom and the top platforms to raise and lower the top platform with respect to the bottom platform, the linkage having scissors legs which pivot about a pivot axis;

a drive system for providing a horizontal force to the scissors linkage;

an unlocking mechanism that lifts the pivot axis in response to the horizontal force to unlock and lift the scissors legs from a retracted and aligned position so that the horizontal force can then be applied to the scissors linkage to raise the top platform with respect to the bottom platform; and a first projection disposed at the pivot axis wherein the unlocking mechanism is a first ramp that slides along the bottom platform in a path that is aligned with the first projection such that the first ramp contacts and lifts the first projection as a result of the horizontal force.

2. The system of claim 1, further comprising a strap operably connected to the first ramp wherein the strap is pulled or released in the horizontal direction to provide the horizontal force.

3. The system of claim 2 wherein the drive system comprises a reversible motor which can pull and release the strap.

4. The system of claim 3, further comprising a head plate which connects the first ramp and the strap.

5. The system of claim 4, wherein the strap is operably connected to the scissors linkage to raise and lower the scissors linkage and the top platform with respect to the bottom platform when the strap is pulled or released, respectively, in the horizontal direction.

6. The system of claim 5, further comprising a foot plate that is slidably secured to the bottom plate and is secured to one of the scissors legs, wherein the foot plate further includes a rod around which the strap is wrapped to raise the scissors legs in response to the horizontal force once the scissors legs are unlocked and no longer aligned.

7. The system of claim 6, further comprising a horizontal rod that is fixedly secured to the bottom platform and upon which the foot plate slides a scissors leg moves relative to the bottom platform.

8. The system of claim 7, further comprising a limit switch which stops the motor when the foot plate has traveled to a specified location.

9. The system of claim 4, further comprising a stopper fixedly attached to the bottom platform to limit the movement of the head plate once the first ramp has engaged and lifted the first projection, thereby unlocking the aligned scissors legs.

10. The system of claim 3, wherein the motor further includes a drive shaft to which a spool is secured, the strap being wound or unwound about the spool.

11. The system of claim 10, wherein the strap is secured at a first end to the spool, is threaded around a rod of a foot plate, and is secured at a second end to a head plate.

12. The system of claim 3, further comprising a controller that receives and processes inputs to generate an output signal that controls operation of the motor.

13. The system of claim 12, wherein a pressure sensing switch is one of the inputs to the controller to indicate when an object is caught between the top and bottom platforms to stop the motor.

14. The system of claim 3, further comprising spacers disposed on the strap to equilibrate a rate at which the strap is wound and unwound by the motor.

15. The system of claim 1, further comprising a second ramp fixedly secured to the bottom platform and aligned along the path of movement for the first ramp.

16. The system of claim 15, comprising a strap operably connected to the first ramp, wherein when the strap is pulled, the horizontal force slides the first ramp onto the second ramp.

* * * * *